US010914530B2

(12) United States Patent
Etienne et al.

(10) Patent No.: US 10,914,530 B2
(45) Date of Patent: Feb. 9, 2021

(54) FIN HEAT EXCHANGER COMPRISING IMPROVED LOUVRES

(71) Applicant: Valeo Systemes Thermiques, Le Mesnil Saint Denis (FR)

(72) Inventors: Erwan Etienne, Le Mesnil Saint Denis (FR); Patrick Boisselle, Le Mesnil Saint Denis (FR); Samuel Bry, Le Mesnil Saint Denis (FR); Nicolas Francois, Le Mesnil Saint Denis (FR); Christophe Lenormand, Le Mesnil Saint Denis (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 27 days.

(21) Appl. No.: 15/745,629

(22) PCT Filed: Jul. 6, 2016

(86) PCT No.: PCT/EP2016/065918
§ 371 (c)(1),
(2) Date: Jun. 6, 2018

(87) PCT Pub. No.: WO2017/012867
PCT Pub. Date: Jan. 26, 2017

(65) Prior Publication Data

US 2018/0266772 A1 Sep. 20, 2018

(30) Foreign Application Priority Data

Jul. 17, 2015 (FR) ..... 15 56760

(51) Int. Cl.
*F28F 1/32* (2006.01)
*F28D 1/053* (2006.01)

(52) U.S. Cl.
CPC ..... *F28F 1/325* (2013.01); *F28D 1/05366* (2013.01); *F28F 2240/00* (2013.01); *F28F 2275/125* (2013.01)

(58) Field of Classification Search
CPC .. F28F 1/325; F28F 2240/00; F28F 2275/125; F28F 1/128; F28F 3/027; F28F 2215/08; F28D 1/05366
(Continued)

(56) References Cited

U.S. PATENT DOCUMENTS 4,328,861 A * 5/1982 Cheong ..... F28D 1/0316 165/151
4,434,844 A * 3/1984 Sakitani ..... F28F 1/325 165/133
(Continued)

FOREIGN PATENT DOCUMENTS

CN 101655296 A 2/2010
CN 201876180 U 6/2011
(Continued)

OTHER PUBLICATIONS

International Search Report issued in PCT/EP2016/065918 dated Aug. 5, 2016 (3 pages).
(Continued)

*Primary Examiner* — Tho V Duong
*Assistant Examiner* — Raheena R Malik
(74) *Attorney, Agent, or Firm* — Osha Bergman Watanabe & Burton LLP

(57) ABSTRACT

The invention relates to a heat exchanger comprising:
at least one row of tubes (2),
at least one fin (4) disposed transversely to said row of tubes (2),
the tubes being connected to the fin (4) by clamping the tubes (2) in a collar (6) formed in the fin (4); and
(Continued)

at least one row (10) of louvers (12), said row (10) being formed in the fin (4) and interposed between two tubes (2) in the row of tubes.

With the fin (4) having a flat rectangular overall shape, the ratio between the number of louvers (12) and the width of the fin (4) is between 0.73 and 1.13.

9 Claims, 3 Drawing Sheets

(58) Field of Classification Search
USPC ..... 165/151
See application file for complete search history.

(56) References Cited

U.S. PATENT DOCUMENTS 4,705,105 A * 11/1987 Cur ..... F28F 1/325 165/151
5,062,475 A 11/1991 Bemisderfer et al.
5,076,353 A * 12/1991 Haussmann ..... F25B 39/04 165/110
5,109,919 A * 5/1992 Sakuma ..... F28F 1/325 165/151
5,207,270 A * 5/1993 Yokoyama ..... F28F 1/325 165/151
5,509,469 A * 4/1996 Obosu ..... F28F 1/325 165/151
5,582,244 A * 12/1996 Helms ..... F28F 1/32 165/151
5,692,561 A * 12/1997 Kang ..... F28F 1/325 165/151
5,722,485 A * 3/1998 Love ..... F28F 1/325 165/151
5,732,768 A * 3/1998 Fraulo ..... F28F 1/32 165/151
5,752,567 A * 5/1998 Obosu ..... F28F 1/325 165/151
5,775,413 A * 7/1998 Kawanabe ..... F28F 1/32 165/151
5,947,194 A * 9/1999 Baek ..... F28F 1/325 165/151
5,975,199 A * 11/1999 Park ..... F28F 1/325 165/151
5,975,200 A * 11/1999 Kato ..... F28F 1/325 165/151
7,182,127 B2 * 2/2007 Oh ..... F28F 1/32 165/151
7,261,147 B2 * 8/2007 Oh ..... F28D 1/0477 165/151
7,578,339 B2 * 8/2009 Kaga ..... F28F 1/32 165/109.1
8,267,160 B2 * 9/2012 Hancock ..... F28F 1/325 165/151
8,978,743 B2 * 3/2015 Tamura ..... F24F 1/18 165/151
9,638,476 B2 * 5/2017 Kerler ..... F28F 1/325
D800,282 S * 10/2017 Hanson ..... D23/323
2005/0016718 A1 * 1/2005 Papapanu ..... F28F 1/325 165/151
2009/0308585 A1 * 12/2009 Chen ..... F28D 1/0475 165/185
2013/0264038 A1 * 10/2013 Kerler ..... F28F 1/325 165/166

FOREIGN PATENT DOCUMENTS

EP 0 086559 A2 8/1983
EP 2 447 656 A2 5/2012
EP 2 447 659 A2 5/2012
FR 2 866 948 A1 9/2005
WO 2006/005594 A1 1/2006
WO 10 2012 002234 A1 8/2013

OTHER PUBLICATIONS

Written Opinion of the International Searching Authority issued in PCT/EP2016/065918 dated Aug. 5, 2016 (5 pages).
International Preliminary Report on Patentability from PCT/EP2016/065918 completed on Jan. 23, 2018 (6 pages).
Rejection Decision in corresponding Chinese Application No. 201680047023.5, dated Jul. 31, 2020 (7 pages).

* cited by examiner

FIN HEAT EXCHANGER COMPRISING IMPROVED LOUVRES

The present invention relates to a heat exchanger, and more particularly to a mechanical heat exchanger.

A heat exchanger generally comprises tubes, through which a heat transfer fluid is intended to flow, and heat exchange elements connected to these tubes.

A distinction is usually made between brazed heat exchangers and mechanical heat exchangers depending on the method for manufacturing them.

In a mechanical heat exchanger, the heat exchange elements, referred to as "fins" in this case, are connected to the tubes in the following way. First of all, through-holes for the tubes to pass through are made in the fins. These through-holes are generally each delimited by a raised edge forming a neck. Next, the fins are disposed substantially parallel to one another and each tube is inserted into a series of aligned holes in the fins. Finally, a radial expansion of the tubes is brought about by passing an expansion tool through the inside of these tubes so as to mechanically join the tubes and the fins by crimping, the necks delimiting the through-holes for the tubes then forming collars clamped around the tubes.

In order to increase the heat exchange between the fins and the air flow, rows of louvers are usually provided on the fins, which have a flat rectangular overall shape, said louvers forming deflectors and being interposed between the tubes in one and the same row of tubes. In this way, the coefficient of convective heat exchange is improved.

In the prior art, the ratio between the number of louvers and the width of each fin is very often chosen depending on the possibilities afforded by the tools for manufacturing the fins and not on the performance of the heat exchanger.

The aim of the invention is to propose a heat exchanger in which the heat exchange performance is improved.

To this end, the subject of the invention is a heat exchanger comprising:

at least one row of tubes, at least one fin disposed transversely to said row of tubes, the tubes being connected to the fin by clamping the tubes in a collar formed in the fin; and at least one row of louvers, said row being formed in the fin and interposed between two tubes in the row of tubes, characterized in that, with the fin having a flat rectangular overall shape, the ratio between the number of louvers and the width of the fin is between 0.73 and 1.13.

It has been found, surprisingly, that a ratio between the number of louvers and the width of the fin that is chosen in this specific range makes it possible to significantly increase the performance of the heat exchanger, while limiting pressure losses.

This is because below 0.73, it has been found that the power of heat exchange is not satisfactory. On the other hand, above 1.13, the gain in performance is not advantageous given the increase in pressure losses.

Preferably, the ratio between the number of louvers and the width of the fin is between 0.87 and 1, preferably being 0.93.

The ratio of 0.93 appears to be a good compromise between the power of the heat exchange and the pressure loss.

According to one particular embodiment of the invention, with the heat exchanger comprising superposed first and second fins, each first fin comprises an oblong hole for a tube to pass through and at least one spacer for spacing apart from the second fin, the length of each row of louvers of each fin being equal to the length of the oblong hole, and each row of louvers of each fin comprising an end referred to as a narrow end, extending between the oblong hole and the spacer, the number of louvers at the narrow end being an integer.

This makes it possible to improve the heat exchange performance by inserting as many louvers as possible into the space between the spacers and the tube.

According to one particular embodiment of the invention, with the heat exchanger comprising superposed first and second fins, each first fin comprising an oblong hole for a tube to pass through and at least one spacer for spacing apart from the second fin, each row of louvers of each fin comprising an end referred to as a narrow end, extending between the oblong hole and the spacer, and an end referred to as a wide end, the narrow ends of two consecutive rows of louvers are arranged in each case close to opposite edges of the fin.

This makes it possible to devote a larger part of the surface area of the fin to the louvers, thereby making it possible to further increase the heat exchange between the air flow and the fin.

According to one particular embodiment of the invention, at least one spacer comprises two mutually parallel flat tabs.

According to one particular embodiment of the invention, an angle between an orientation vector and a reference vector is between −10 degrees and 20 degrees, the orientation vector being a vector, the direction of which is a direction substantially parallel to a tab and substantially parallel to the fin and the sense of which is the sense running from the narrow end toward the wide end, and a reference vector being a vector, the direction of which is a direction transverse to the fin and the sense of which is the sense running from the narrow end toward the wide end, the angle becoming negative when the air flow, which is oriented in the same sense as the reference vector, tends to deviate from the row of louvers, and becoming positive in the opposite case.

In the prior art, the angle between the reference vector and orientation vector as defined is generally less than −15 degrees, corresponding to a configuration in which the air flow redirected by a spacer is directed toward the closest tube.

However, it has been found that orienting each spacer further toward the row of louvers, and not toward the closest tube, makes it possible to further increase the heat exchange between the air flow and the fin.

The invention will be understood better from reading the following description, which is given solely by way of example and with reference to the drawings, in which:

FIG. 5 shows a mechanical heat exchanger 1 intended to equip a motor vehicle.

Figure 1:
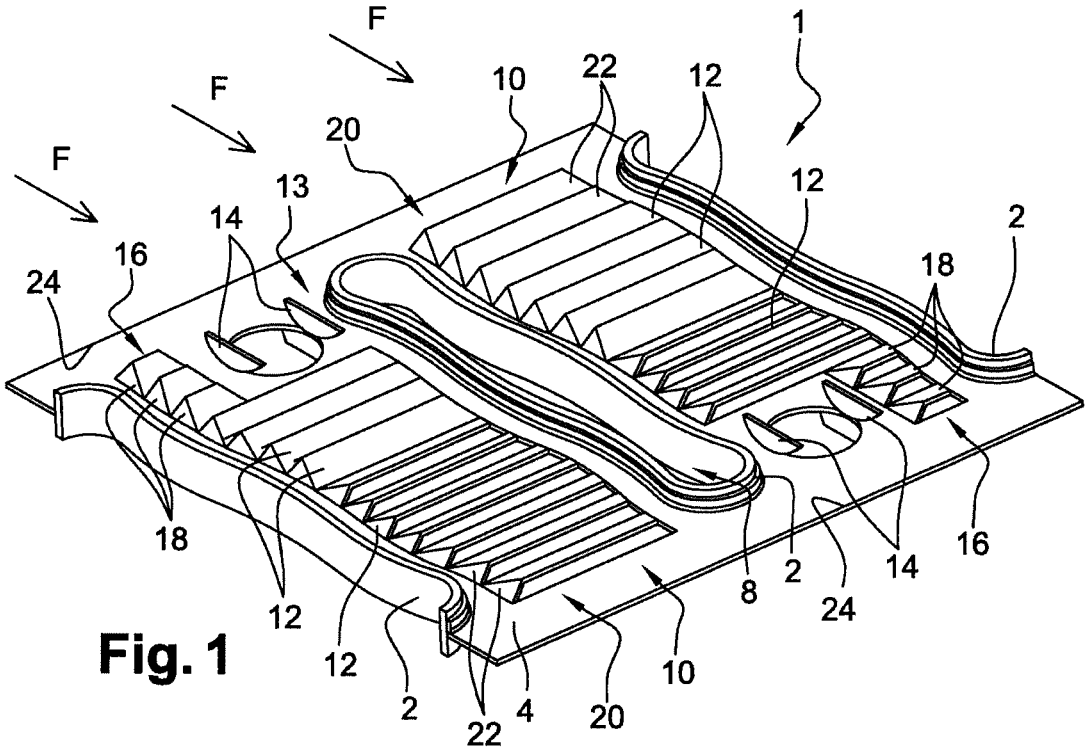
FIG. 1 is a perspective view of part of a fin and tubes of a heat exchanger according to a first embodiment of the invention.

The heat exchanger comprises a row of tubes 2 (shown in a truncated manner for reasons of clarity), through which a conventional heat transfer fluid is intended to flow, and superposed fins 4 (only one of which is shown for reasons of clarity) connected to these tubes 2.

The tubes 2 are connected to the fins 4 by clamping the tubes in collars 6 formed in the fins 4. To this end, the fins 4 are provided with through-holes 8 for the tubes to pass through. These through-holes 8 have an oblong overall shape. In the following, they will be referred to as oblong holes 8.

In the example described, the tubes 2 each have an elongate overall shape and have a substantially oblong cross section. The tubes 2 are arranged substantially parallel to one another, so as to form a single row.

The fins 4 have a substantially flat rectangular overall shape and are arranged in the heat exchanger 1 in a manner substantially parallel to one another and perpendicular to the longitudinal directions of the tubes 2.

The heat exchanger 1 is intended to be passed through from upstream to downstream by a flow of air, the fins 4 being intended to extend through this flow. Arrows F indicate the direction of travel of the flow.

In order to increase the heat exchange between the flow F and the fins 4, the heat exchanger 1 also comprises rows 10 of louvers 12, which are formed in each fin 4 and are each interposed between two tubes 2.

In the embodiments shown in FIGS. 1 to 4, the ratio between the number of louvers 12 and the width of the fin 4 is between 0.73 and 1.13. The ratio is expressed in louvers per mm.

Preferably, this ratio is between 0.87 and 1, and is for example equal to 0.93. The latter choice constitutes a good compromise between performance of the heat exchanger 1 and pressure losses.

Specifically, tests have for example shown that, with a ratio above 1.13, the gain in performance compared with a ratio of 0.93 is 0.4%, this not being advantageous with regard to the increase in external pressure losses, which is 3.4%.

By contrast, other tests have revealed that, with a ratio less than 0.73, a satisfactory heat exchange power is not obtained since the latter decreases, compared with a ratio of 0.93, by 3.6%.

With the aid of these tests, it was determined that a particularly satisfactory ratio was 0.93. Above 1.13, there is a gain in power, but the cost in terms of pressure losses is too high. By contrast, below 0.73, the power level is insufficient.

The heat exchanger 1 also comprises spacers 13 between two superposed fins 4.

More particularly, the spacers 13 comprise two flat, mutually parallel tabs 14.

The spacers 13 are produced for example from a punched hole in the fin 4.

In the example shown in the figures, the tabs 14 are each in the overall shape of a half-disk.

In the embodiments shown in FIGS. 1 to 4, the length of the row 10 of louvers is equal to the length of the oblong through-holes 8 for the tubes 2 to pass through.

Each row 10 of louvers of the fin 4 comprises an end 16 referred to as a narrow end, extending between the oblong hole 8 and the spacer 13.

On account of the presence of the spacers 13, the louvers 18 at the narrow end 16 are less long than all the other louvers 12 in the row 10.

For each row 10 of louvers, the number of narrow-end louvers 18 extending between the hole 8 and the spacers 14 is an integer.

Figure 2:
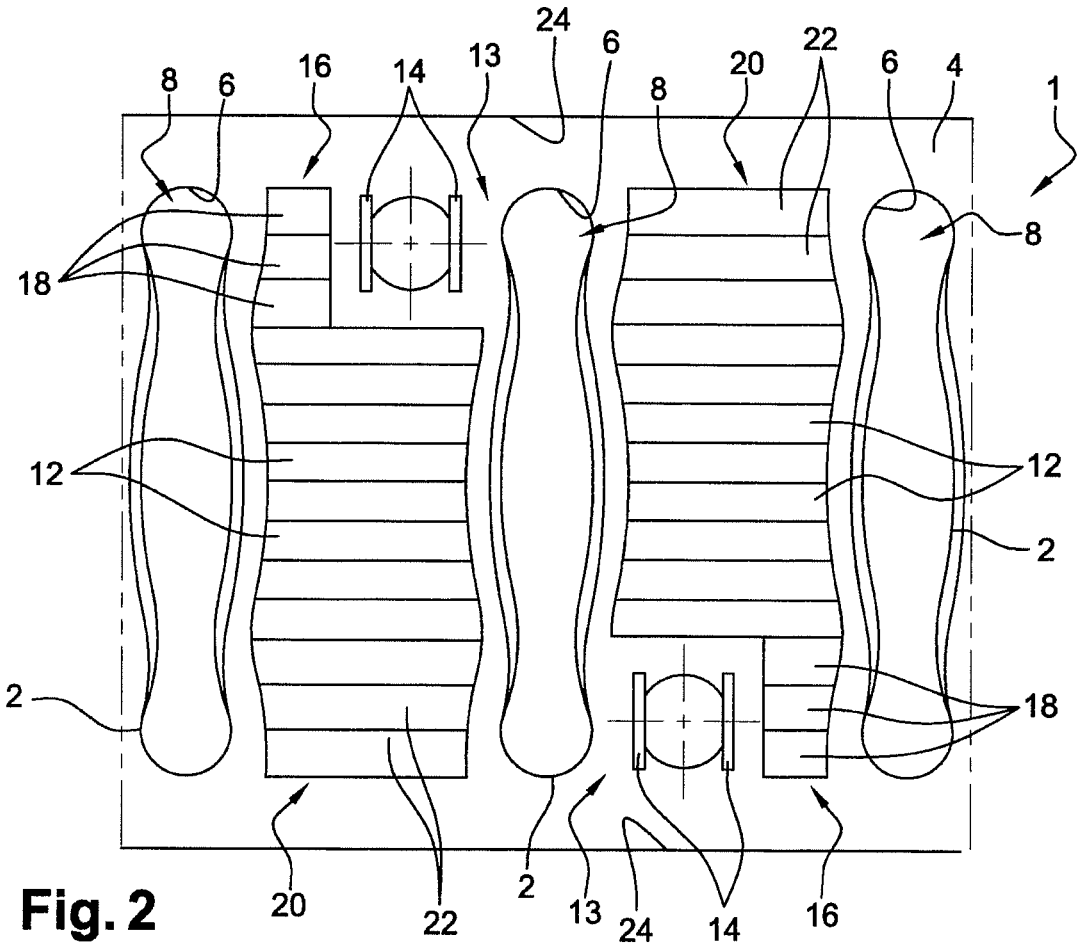
FIG. 2 is a top view of the fin from FIG. 1.

For example, as can be seen in FIG. 2, exactly three narrow-end louvers 18 extend between an oblong hole 8 and a spacer 13.

Furthermore, each row 10 of louvers 10 of the fin 4 comprises an end 20 referred to as a wide end, in which the louvers 22 are longer than those at the narrow end 16.

Thus, in the example shown, the fin 4 is provided with a single spacer 13 between two consecutive tubes 2 in the row of tubes 2, and not two between two consecutive tubes 2 as in the prior art.

The narrow ends 16 of two consecutive rows 10 of louvers are more particularly arranged in each case close to opposite edges 24 of the fin 4, as can be seen in FIGS. 1 and 2.

Figure 3:
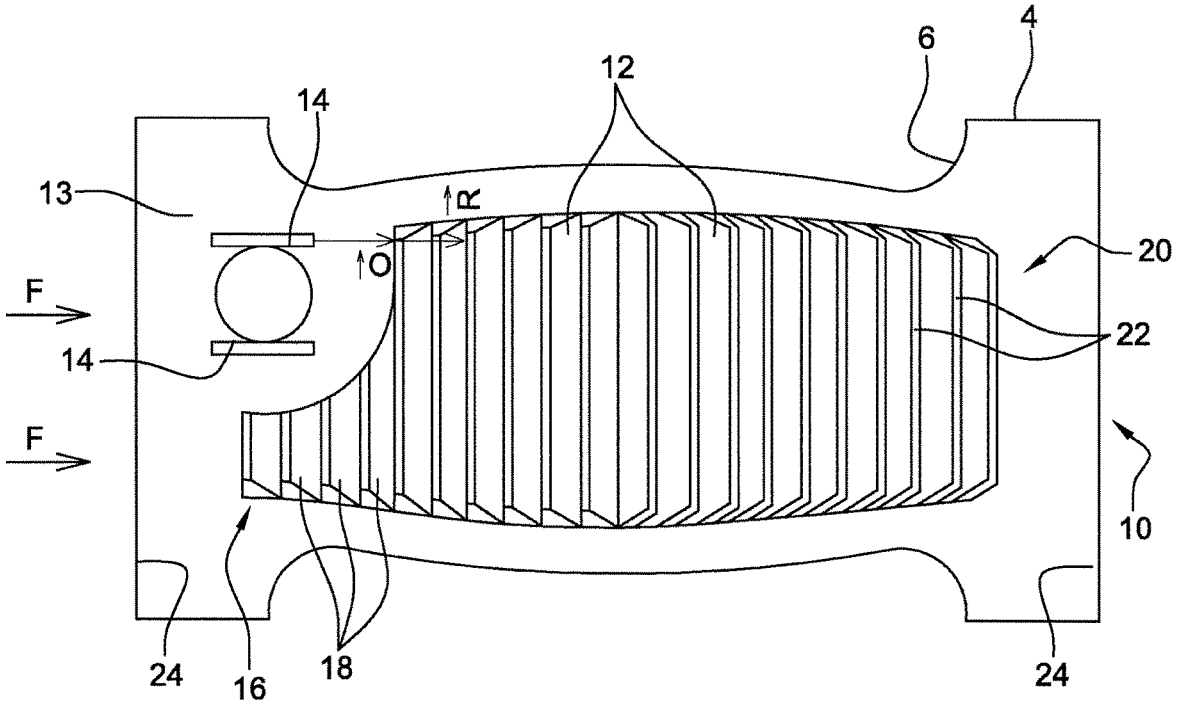
FIG. 3 is a top view of a row of louvers of the heat exchanger from FIG. 1.
Figure 4:
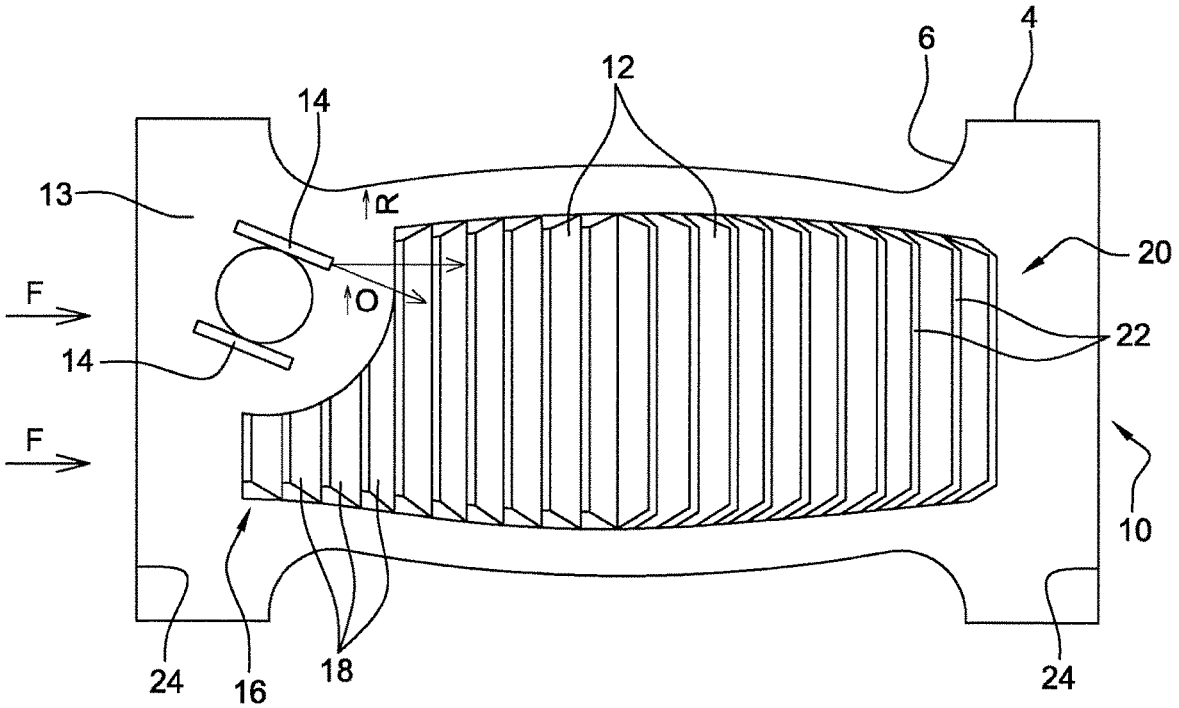
FIG. 4 is a view similar to FIG. 3 showing a row of louvers of a heat exchanger according to a second embodiment.
Figure 5:
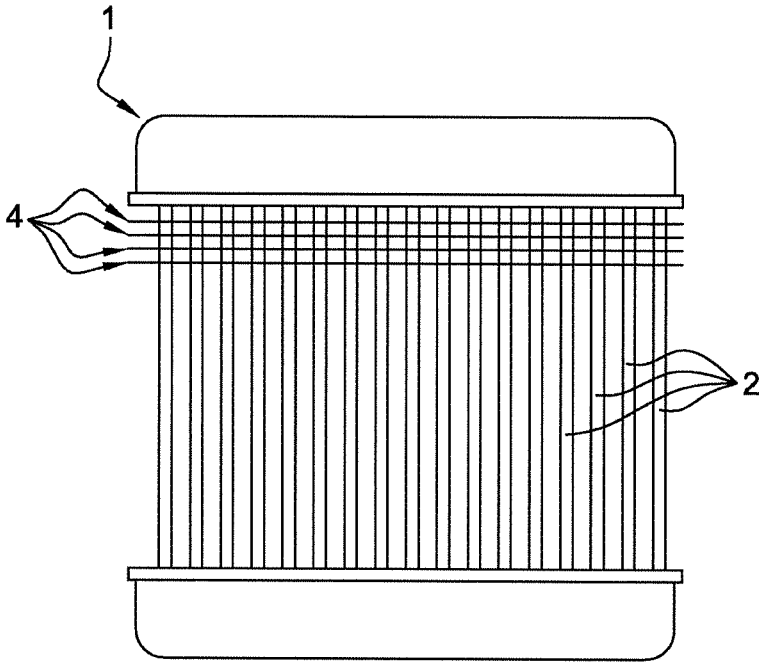
FIG. 5 is a schematic view of a heat exchanger according to the invention.

As illustrated in FIGS. 3 and 4, an orientation vector O is defined as being a vector, the direction of which is a direction substantially parallel to a tab 14 and the fin 4 and the sense of which is the sense running from the narrow end 16 toward the wide end 17.

Likewise, a reference vector R is defined as being a vector, the direction of which is the direction transverse to the fin 4 and the sense of which is the sense running from the narrow end 16 toward the wide end 17.

In all the embodiments shown in the figures, the angle $\alpha$ between the orientation vector O and the reference vector R is between −10 degrees and 20 degrees.

In the following text, the angle $\alpha$ will be considered to become negative when the air flow F, which is oriented in the same sense as the reference vector, tends to deviate from the adjacent row 10 of louvers, that is to say toward the tube 2 closest to the spacer 13 in the examples shown.

In particular, in the first embodiment of the invention that is illustrated in FIGS. 1 to 3, this angle $\alpha$ is zero. Thus, the tabs 14 of the spacers 13 are substantially parallel to the transverse direction of the fin 4.

By contrast, the angle $\alpha$ becomes positive when the air flow F redirected by the spacers 13 tends to be directed further toward the adjacent row 10 of louvers, as is the case in FIG. 4, which illustrates a second embodiment of the invention.

In this second embodiment, the angle $\alpha$ between the orientation vector O and the reference vector R is, in accordance with the convention defined above, equal to 15 degrees.

This final configuration provides good results with regard to the performance of the heat exchanger 1.

The invention is not limited to the embodiments presented, and further embodiments will be clearly apparent to a person skilled in the art.

In particular, a combination of the different embodiments can also be envisioned in order to obtain the desired effects.

The invention claimed is:

1. A heat exchanger comprising:

at least one row of tubes;

fins disposed transversely to said row of tubes;

the tubes being connected to the fins by clamping the tubes in a collar formed in the fins; and at least one row of louvers, said row being formed in the fins and interposed between two tubes in the row of tubes, wherein, with the fins having a flat rectangular overall shape, a ratio between a number of louvers and a width of the fin is between 0.73 and 1.13 louvers/mm; and a first fin and a second fin of the fins superposed together, the first fin comprising an oblong hole for a tube to pass through and at least one spacer for spacing apart from the second fin, wherein a length of each row of louvers of each of the first fin and the second fin is equal to a length of the oblong hole, and each row of louvers of each of the first fin and the second fin comprises a narrow end, extending between the oblong hole and the spacer, wherein the spacer is only at the narrow end, wherein each row of louvers of each of the first fin and the second fin comprises, and wherein the narrow ends of two consecutive rows of louvers are arranged in each case close to opposite edges of the fins.

2. The heat exchanger as claimed in claim 1, wherein the ratio between the number of louvers and the width of the fins is between 0.87 and 1 louvers/mm.

3. The heat exchanger as claimed in claim 1, wherein at least one spacer comprises two mutually parallel flat tabs.

4. The heat exchanger as claimed in claim 3, further comprising:

an orientation vector directed substantially parallel to the tabs and substantially parallel to the fins and directed from the narrow end toward a second end referred to as a wide end; and a reference vector directed substantially transverse to the fins and directed from the narrow end toward the wide end, wherein an angle between the orientation vector and the reference vector is between −10 degrees and 20 degrees, and wherein the angle is negative when an air flow, which is initially flowing in the same direction as the reference vector, is diverted by the at least one spacer toward a tube closest to the at least one spacer, and is positive in the opposite case.

5. A heat exchanger comprising:

at least one row of tubes, the tubes comprising an elongate shape overall and a substantially oblong cross section;

a plurality of fins, each fin comprising a substantially flat rectangular overall shape, arranged substantially parallel to one another and substantially perpendicular to a longitudinal direction of the tubes, and connected to the at least one row of tubes;

at least one row of louvers formed in each fin and interposed between two of the tubes;

at least one spacer formed in each fin, each spacer comprising two mutually parallel flat tabs, wherein a ratio of a number of louvers in each fin to a width of each fin is greater than or equal to 0.73 louvers/mm and less than or equal to 1.13 louvers/mm, wherein the spacer is only at a narrow end of each row of louvers of each fin, wherein each row of louvers of fin comprises a wide end at an end opposite the narrow ends, wherein the wide end is wider than the narrow end, and wherein the narrow ends of two consecutive rows of louvers are arranged in each case close to opposite edges of the fins.

6. The heat exchanger as claimed in claim 5, wherein each tab is in the overall shape of a half-disk.

7. The heat exchanger as claimed in claim 5, wherein each fin comprises a plurality of oblong through-holes, each through-hole shaped to receive one tube, and wherein a length of the at least one row of louvers is equal to a length of the oblong through-hole.

8. A method of heat exchange comprising:

flowing a first fluid through at least one row of tubes;

flowing a second fluid substantially parallel to a plurality of fins, each fin connected to each tube in the at least one row of tubes and disposed substantially perpendicular to each tube, wherein each fin comprises a flat rectangular overall shape, wherein at least one row of louvers is formed in each fin and is interposed between two of the tubes, wherein a ratio of a number of louvers in each fin to a width of each fin is greater than or equal to 0.73 louvers/mm and less than or equal to 1.13 louvers/mm, wherein at least one spacer formed in each fin is only positioned at a narrow end of each row of louvers of each fin, wherein a wide end of each row of louvers of each fin is at an end opposite the narrow end, wherein the wide end is wider than the narrow end, and wherein the narrow ends of two consecutive rows of louvers are arranged in each case close to opposite edges of the fins.

9. The method of heat exchange as claimed in claim 8, wherein the first fluid is a heat transfer fluid and the second fluid is air.

* * * * *